US009250082B2

(12) United States Patent
Frizlen

(10) Patent No.: US 9,250,082 B2
(45) Date of Patent: Feb. 2, 2016

(54) METHOD AND SYSTEM FOR DETERMINING DISPLACEMENT OF AN ANCHOR

(71) Applicant: Thomas Frizlen, Bremgarten AG (CH)

(72) Inventor: Thomas Frizlen, Bremgarten AG (CH)

(73) Assignee: Thomas Frizlen, Bremgarten (CH)

( * ) Notice: Subject to any disclaimer, the term of this patent is extended or adjusted under 35 U.S.C. 154(b) by 0 days.

(21) Appl. No.: 14/175,375

(22) Filed: Feb. 7, 2014

(65) Prior Publication Data

US 2014/0222336 A1 Aug. 7, 2014

(30) Foreign Application Priority Data

Feb. 7, 2013 (CH) ..... 0410/13
Feb. 6, 2014 (EP) ..... 14154136

(51) Int. Cl.
*G01C 21/10* (2006.01)
*G01C 21/02* (2006.01)
(Continued)

(52) U.S. Cl.
CPC ..... *G01C 21/16* (2013.01); *B63B 21/22* (2013.01); *B63B 2021/008* (2013.01); *B63B 2021/009* (2013.01)

(58) Field of Classification Search
CPC .... G01C 21/16; G01C 21/165; G01C 22/006; G01C 15/002; G01C 25/005; G01C 9/00; G01C 13/00; G01C 21/00; G01C 3/08; G06F 17/30241; G06F 19/22; G06F 3/011; G06F 15/80; B63B 1/121; B63B 1/22; B63B 21/66; B63B 22/06; B63B 27/24; B63B 35/34; B63B 43/20; B63B 59/08
USPC ..... 701/507, 526, 527, 472, 500, 141, 153, 701/160, 85, 86, 21, 2, 501, 518, 23, 29.7, 701/536; 702/141, 153, 160, 85, 86
See application file for complete search history.

(56) References Cited

U.S. PATENT DOCUMENTS 4,140,991 A * 2/1979 Singleton ..... H04B 13/02 340/852
4,912,464 A * 3/1990 Bachman ..... B63B 21/22 114/293

(Continued)

FOREIGN PATENT DOCUMENTS

AU A31633/84 2/1986
AU 199655052 11/1996

(Continued)

OTHER PUBLICATIONS

Nilsson, et al., "Foot-mounted INS for Everybody—An Open-Source Embedded Implementation", 2012 IEEE/ION Position Location and Navigation Symposium (PLANS), Myrtle Beach, SC, Apr. 23-26, 2012, pp. 140-145.

(Continued)

*Primary Examiner* — Calvin Cheung
*Assistant Examiner* — Luis A Martinez Borrero
(74) *Attorney, Agent, or Firm* — Stradley Ronon Stevens & Young LLP

(57) ABSTRACT

A method for determining a displacement of an anchor comprises the steps of: determining an initial position of the anchor; determining a displacement of the anchor by measuring anchor acceleration values, measuring at least one further physical quantity associated with the anchoring, deciding whether the anchor is at rest or in motion, wherein a value of the further physical quantity is taken into account in the decision, and integrating the acceleration values twice over time during intervals when the anchor is deemed to be in motion.

13 Claims, 1 Drawing Sheet

(51) Int. Cl.

| | |
|---|---|
| ***G01C 21/16*** | (2006.01) |
| ***B63B 21/22*** | (2006.01) |
| *B63B 21/00* | (2006.01) |

(56) References Cited

U.S. PATENT DOCUMENTS

| | | | | | |
|---|---|---|---|---|---|
| 5,062,375 | A * | 11/1991 | Makielski | B63B 21/18 | 114/210 |
| 5,077,696 | A | 12/1991 | McEachern et al. | | |
| 5,445,103 | A * | 8/1995 | Bleth | B63B 21/22 | 114/293 |
| 5,491,636 | A * | 2/1996 | Robertson | B63H 25/42 | 114/144 B |
| 5,803,008 | A * | 9/1998 | Georgens | B63B 21/04 | 114/293 |
| 5,894,450 | A * | 4/1999 | Schmidt | H04B 13/02 | 367/131 |
| 5,970,901 | A | 10/1999 | Bruce | | |
| 6,142,841 | A * | 11/2000 | Alexander, Jr. | B63H 11/08 | 114/151 |
| 6,374,765 | B1 * | 4/2002 | Marotta | B63B 21/22 | 114/293 |
| 6,446,003 | B1 * | 9/2002 | Green | G01C 21/20 | 342/357.3 |
| 6,459,992 | B1 * | 10/2002 | Freedman | E21B 47/02 | 324/303 |
| 6,472,983 | B1 * | 10/2002 | Grunder | B63B 21/00 | 340/531 |
| 6,678,589 | B2 * | 1/2004 | Robertson | B63H 25/42 | 114/246 |
| 6,728,632 | B2 * | 4/2004 | Medl | G01C 21/00 | 701/500 |
| 6,810,826 | B1 * | 11/2004 | Bellis, Jr. | B63B 21/04 | 114/102.19 |
| 7,121,222 | B1 * | 10/2006 | Johnston | B63B 21/22 | 114/293 |
| 7,366,593 | B2 * | 4/2008 | Fujimoto | G05D 1/0206 | 701/21 |
| 7,376,507 | B1 * | 5/2008 | Daily | G01C 21/00 | 340/988 |
| 8,055,193 | B2 * | 11/2011 | Rhodes | H04B 13/02 | 340/572.7 |
| 8,340,830 | B2 * | 12/2012 | Hayes | G06F 1/3203 | 340/539.13 |
| 8,924,054 | B1 * | 12/2014 | Arbuckle | B63H 21/21 | 701/21 |
| 9,074,892 | B2 * | 7/2015 | Fink | G01C 21/00 | |
| 2003/0128138 | A1 | 7/2003 | Grunder | | |
| 2005/0052951 | A1 * | 3/2005 | Ray | G01V 1/247 | 367/188 |
| 2006/0207488 | A1 | 9/2006 | Haas | | |
| 2007/0042790 | A1 * | 2/2007 | Mohi | G01C 21/20 | 455/456.5 |
| 2007/0089660 | A1 * | 4/2007 | Bradley | B63H 25/42 | 114/144 A |
| 2007/0106462 | A1 * | 5/2007 | Blain | G05D 1/10 | 701/518 |
| 2008/0239869 | A1 | 10/2008 | Lohrmann et al. | | |
| 2011/0087450 | A1 | 4/2011 | Borenstein et al. | | |
| 2012/0072038 | A1 * | 3/2012 | Kolar | G06F 1/3262 | 700/291 |
| 2013/0301909 | A1 * | 11/2013 | Sato | G01B 11/25 | 382/154 |

FOREIGN PATENT DOCUMENTS

| | | |
|---|---|---|
| DE | 3810084 | 10/1989 |
| DE | 10064419 | 7/2002 |
| DE | 202011002391 | 5/2011 |
| EP | 0174189 | 3/1996 |
| WO | 2007020523 | 2/2007 |

OTHER PUBLICATIONS

Bonde, et al., "Air Deployed Oceanographic Mooring-AB1034", CH 1972-9/83/0000-0237, 1983 IEEE, pp. 237-250.

Liu, et al., "Experimental investigation on the penetration mechanism and kinematic behavior of drag anchors", Applied Ocean Research, 32 (2010) pp. 434-442.

European Search Report issued in EP 14154136.7 dated Jul. 11, 2014.

Swiss Search Report issued in CH707573 dated May 10, 2013.

* cited by examiner

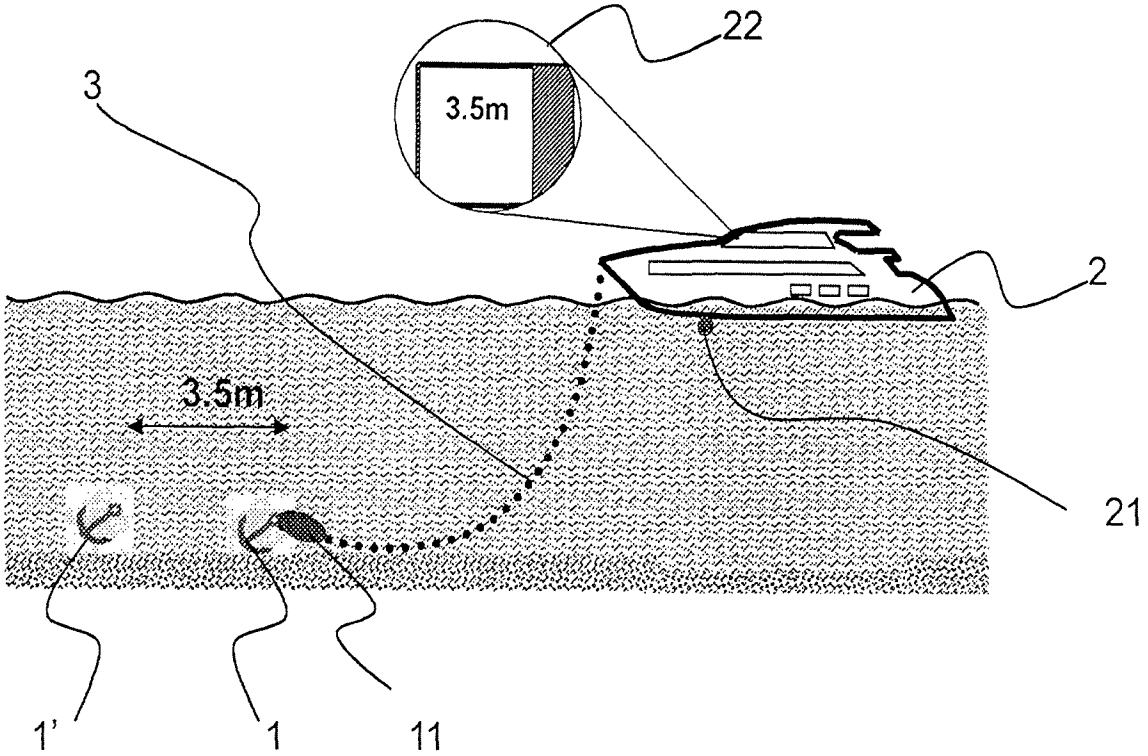
22
3.5m
2
21
3
3.5m
11
1
1'

METHOD AND SYSTEM FOR DETERMINING DISPLACEMENT OF AN ANCHOR

CROSS REFERENCE TO RELATED APPLICATIONS

This application claims priority to European Patent Application No. EP 14154136.7 filed Feb. 6, 2014 and Swiss Patent Application No. CH00410/13 filed Feb. 7, 2013, the contents of each of which are incorporated by reference herein in their entireties for all purposes.

FIELD OF THE INVENTION

The present invention pertains to the field of anchoring of water vessels. It relates to a method and system for determining displacement of an anchor and to use of an acceleration sensor for determining a displacement of an anchor.

BACKGROUND OF THE INVENTION

Reliable anchoring is an important requirement for all kinds of water vessels, in particular rafts, boats, and ships, but also floating platforms and other semi-stationary objects. If one or more anchors come loose, significant damage can result to the water vessel, other water vessels, and/or crew, passengers etc.

Various methods for anchor monitoring have therefore been suggested.

U.S. Pat. No. 4,912,464 suggests an alarm system comprising a motion sensor connected to an anchor, and configured to monitor a motion signal produced by said motion sensor and raise an alarm under certain conditions, in particular when an acceleration above a threshold occurs.

U. S. Patent Application Publication No. 2003/0128138 A1 discloses a device that generates an alarm when a condition at an anchor or an anchor chain exceeds a set value, in particular when a jerk exceeds a predetermined measure, or when a predetermined force is exceeded.

DE 100 64 419 A1 discloses a movement or inclination monitoring device that has two or more base bodies, such as an anchor and its chain, that are directly or indirect connected, and two or more measurement elements that are used for continuous measurement of the acceleration of one or more base bodies, measurement of angles $\alpha$ of the base body axes relative to the gravitational force vector, a rotation $\beta$ around a body axis, or a rate of rotation relative to $\alpha$ and/or $\beta$. The measurement elements are linked by cable or in a wireless manner. If a variation in acceleration, angle, rotation angle, or rotational velocity exceeds a predetermined threshold, an alarm signal may be displayed.

DE 38 10 084 A1 describes an alarm device which indicates the breaking loose or slippage of an anchor, said alarm having a position encoder (displacement sensor) which is connected to the anchor and rests with a wheel on the anchor (holding) ground and transmits the breaking away or slippage of the anchor to a signaling device present in the water craft via a pulse generator and a transmission device, such as a cable or in a wireless fashion, e.g., by ultrasound.

However, the quantities measured in the state of the art do not correlate optimally with a displacement of an anchor, and thus, in particular, do not correlate optimally with a reliability of the anchoring. In particular, anchoring may remain reliable if very high forces or jerks occur: the anchor may remain at least essentially stationary under such conditions. Under such conditions, state of the art devices may trigger false alarms. On the other hand, if an anchor has never made firm contact with the ground, both boat and anchor may slowly drift, and the anchor may thus be significantly displaced, without large forces or jerks occurring on the anchor or anchor chain, or without wheels or other rotatable elements attached to the anchor being rotated. Such situations may thus go undetected with the methods and devices according to the state of the art as described above.

SUMMARY OF THE INVENTION

It is thus an object of the invention to allow for determination of a displacement of an anchor, in particular to allow for accurate and reliable determination of displacement without the disadvantages as detailed above.

The above objects are achieved by a method and a system for determining a displacement of an anchor and by use of an acceleration sensor for determining a displacement of an anchor.

In addition, the invention allows for dependable monitoring of an anchoring reliability and/or stability.

Embodiments of the present invention as described below may in particular be realized as and/or in combination with the variants as listed below:

1. A method for determining a displacement of an anchor, the method comprising the steps of:
   (a) determining an initial position of the anchor;
   (b) determining a displacement of the anchor by
      i. measuring anchor acceleration values,
      ii. measuring at least one further physical quantity associated with the anchoring,
      iii. deciding whether the anchor is at rest or in motion, wherein a value of the further physical quantity is taken into account in the decision, and
      iv. during intervals when the anchor is deemed to be in motion, integrating the acceleration values twice over time.
2. The method according to variant 1, characterized in that in step 1.(b)i., the acceleration values are measured using an acceleration sensor.
3. The method according to one of the preceding variants, further comprising the step of ignoring anchor acceleration values measured during intervals when the anchor is deemed to be at rest.
4. The method according to one of the preceding variants, further comprising the step of correcting the integration of the acceleration values based on the anchor acceleration values measured during intervals when the anchor is deemed to be at rest.
5. The method according to one of the preceding variants, wherein the step of measuring at least one further physical quantity comprises measuring vibrations of the anchor, and/or measuring a force exerted onto the anchor through an anchor rode, and/or measuring an underwater pressure at a location of the anchor.
6. The method according to one of the preceding variants, wherein the step of measuring at least one further physical quantity comprises measuring a distance between the anchor and a fixed reference point, in particular measuring a distance between the anchor and a water vessel.
7. The method according to one of the preceding variants, wherein the step of measuring at least one further physical quantity comprises measuring an inclination or orientation of the anchor.
8. A method for monitoring an anchoring reliability, the method comprising the steps of
   (a) determining a displacement of an anchor according to one of variants 1 to 7, and (b) generating a warning message or signal if the displacement exceeds a predetermined alarm threshold.

9. A system for determining a displacement of an anchor, the system comprising:
   (a) a measurement unit for being attached to an anchor and/or an anchor rode, the measurement unit comprising:
      (i) means for acquiring acceleration data, in particular an acceleration sensor, and
      (ii) one or more auxiliary sensors for measuring at least one further physical quantity associated with the anchoring;
   (b) an evaluation unit, in particular for being installed or placed inside a water vessel or in the measurement unit and configured to receive the acceleration data;
   (c) the evaluation unit configured to
      (i) determine anchor acceleration values from the acquired acceleration data, and
      (ii) execute the method according to one of variants 1 through 7.
10. The system according to variant 9, further comprising display means configured to display the displacement and/or an absolute movement, e.g., an absolute value of the displacement, of the anchor.
11. The system according to variant 9 or 10, further comprising display means configured to display the displacement of the anchor as a function of time, force, position, distance, depth and/or orientation.
12. The system according to one of variants 9 to 11, configured to generate a warning message or signal if the displacement, in particular an absolute value of the displacement, exceeds a predetermined alarm threshold.
13. The system according to one of variants 9 to 12, wherein the one or more auxiliary sensors comprise a pressure sensor for measuring underwater pressure; a vibration sensor for measuring vibrations of the anchor; an ultrasound sensor, in particular for measuring a distance between the anchor and a vessel; and/or a force sensor for measuring a force exerted onto the anchor through an anchor rode.
14. A system using an acceleration sensor for determining a displacement of an anchor by integrating, preferably numerically, measured acceleration values twice over time.
15. A system for determining a displacement of an anchor, the system comprising:
   (a) a measurement unit for being attached to an anchor or an anchor rode, the measurement unit comprising:
      i. means for acquiring acceleration data, in particular an acceleration sensor, and
      ii. one or more auxiliary sensors;
   (b) an evaluation unit, in particular for being installed or placed inside a water vessel or in the measurement unit and configured to receive the acceleration data;
   (c) the evaluation unit configured to
      i. determine an initial position of the anchor, in particular when the anchor has reached ground and is deemed to be at rest, and
      ii. determine a displacement of the anchor by
         A. determining anchor acceleration values from the acquired acceleration data,
         B. measuring at least one further physical quantity associated with the anchoring by means of the one or more auxiliary sensors,
         C. deciding whether the anchor is at rest or in motion, wherein a value of the further physical quantity is taken into account in the decision, and
         D. for intervals when the anchor is supposed to be in motion, integrating twice the anchor acceleration values over time.

The aforementioned and further objectives, advantages and features of the invention will be detailed in the description of preferred embodiments below in combination with the drawings.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. The drawing consists of the following FIGURE:

FIG. 1 shows a schematic of an exemplary embodiment of a system for determining a displacement of an anchor in accordance with the present invention.

DETAILED DESCRIPTION OF THE INVENTION

A method for determining a displacement of an anchor is presented. According to the invention, the method comprises the steps of determining an initial position of the anchor; determining a displacement of the anchor by measuring anchor acceleration values, in particular as a function of time; measuring, in particular by using an auxiliary sensor, at least one further physical quantity associated with the anchoring, in particular as a further function of time; deciding whether the anchor is at rest or in motion, wherein a value of the further physical quantity is taken into account in the decision; and integrating the acceleration values twice over time during intervals when the anchor is deemed to be in motion, preferably by numerical integration.

The invention is based on the finding that a displacement of an object like, in particular, an anchor may be determined by continually measuring acceleration of the object, in particular by using an acceleration sensor tightly attached to the object. By recording the measured acceleration values, a numerical representation of acceleration as a function of time is obtained. By integrating this function twice over time, a displacement of the object relative to an initial object position may be obtained, where the initial object position is an instantaneous position taken by the object at the beginning of the integration interval.

To minimize computational errors, which are introduced, e.g., due to measurement inaccuracies and aggravated by twofold integration, additional information about a status of the object may advantageously be taken into account in the computation. In particular, during intervals when such additional information indicates that the object is at rest, measured acceleration values may be disregarded and/or replaced by zero values for the purposes of the integration. In the context of this document, the term "measured values" refers to values as obtained by measurement; in particular in the form of data acquired by a sensor. Measured values generally differ from actual values by an error. In particular, measured acceleration values, also briefly referred to as "acceleration values" in what follows, are obtained by acceleration measurement; in particular in the form of acceleration data acquired by an acceleration sensor, and generally deviate from actual acceleration values by an acceleration error. Thus, measured acceleration values obtained during intervals when the object may be deemed at rest may be completely disregarded; or, preferably, may be disregarded in an actual, preferably numerical, calculation of the integral, e.g., by replacement by zero values, or by interrupting the integration during intervals when the object may be deemed at rest, but used to correct, eliminate, or otherwise compensate for the acceleration error.

Additional information may in particular be obtained from measurements of at least one further physical quantity of or related to the object and/or object surroundings other than acceleration values. In particular, additional information may be obtained by measurements of or related to a location, orientation or velocity of the object. Preferably, additional information is obtained by measurements that are not related to quantities characteristic of a movement of the object, as in particular acceleration, velocity or position with respect to any one or more degrees of freedom of motion of the object, in particular including translational or rotational movement. Preferably, additional information may be obtained by measurements of at least one force acting on the object; measurements of pressure, temperature, magnetic and/or electric field in an environment of the object; and/or measurements of object internal quantities such as stress, tension and/or vibration—all of which may provide useful additional information.

Advantageously, additional information is obtained from data, in particular acceleration data, obtained from the acceleration sensor. Preferably, however, additional information is obtained by using an additional sensor, in particular an auxiliary sensor, which is independent of the acceleration sensor. This allows for a more accurate decision of whether the object is at rest, and thus a more accurate determination of the related intervals.

Preferably, the initial position of the anchor is set when the anchor is or may be deemed to have reached ground and to be at rest, at least for a short instant. Such a situation may preferably be determined based on measurements by auxiliary sensors, in particular by at least one auxiliary sensor, possibly in combination with measured acceleration values as will be detailed below.

Preferably, anchor acceleration values and/or the further physical quantity or quantities is or are measured over a period of time, which is subsequently divided into one or more first intervals and one or more second intervals, wherein the anchor is deemed to be in motion during the first intervals, and deemed to be at rest during the second intervals. Whether the anchor may be deemed to be in motion or deemed to be at rest may again preferably be determined based on measurements by at least one auxiliary sensor as will also be detailed below.

In a preferred variant of the method for determining a displacement of an anchor in accordance with the invention, the step of measuring at least one further physical quantity comprises measuring vibrations, in particular vibration intensity and/or vibration amplitude at one or more frequencies $f_{vib}$, preferably with $f_{vib}>250$ Hz, of the anchor. Advantageously, vibrations may be measured by a vibration detection unit configured to receive acceleration data from the sensor for acquiring acceleration data, in particular the acceleration data sensor, and to measure vibrations of the anchor by extracting vibration data from the acceleration data. Preferably, vibrations are measured, e.g., by a vibration sensor integrated with, attached to or otherwise rigidly connected to the anchor. Vibration measurements thus obtained may be used in deciding whether the anchor is at rest or in motion. In particular, it may be assumed that the anchor is at rest when no vibrations are measured or when measured vibrations are below a predetermined, albeit preferably adjustable first threshold.

Vibration measurements may also be taken into account when determining the initial position of the anchor. In particular, it may be assumed that the anchor has reached the initial position when no vibrations are measured or when measured vibrations are below a predetermined, albeit preferably adjustable second threshold for a first time after the anchor has been lowered, or within a time window around an expected point in time at which the anchor may be expected to touch ground. Such a point in time may be calculated from an estimated sinking speed of the anchor, that may be approximated by known methods, and a depth at the anchoring location determined, e.g., by sonar. A length of the time window T is preferably chosen in the same order of magnitude as an approximated length of time $t_s$ required for the anchor to sink, preferably $0.2\ t_s<T<1.5\ t_s$ most preferably $0.3\ t_s<T<0.75\ t_s$.

In another preferred variant of the method for determining a displacement of an anchor, the step of measuring at least one further physical quantity comprises measuring a force exerted onto the anchor through an anchor rode, e.g., by a force sensor provided between the anchor and the anchor rode. Force measurements thus obtained may be used in deciding whether the anchor is at rest or in motion. In particular, it may be assumed that the anchor is at rest when no forces are measured or when measured forces are below a predetermined, albeit preferably adjustable third threshold.

Force measurements may also be taken into account when determining the initial position of the anchor. In particular, it may be assumed that the anchor has reached the initial position when no forces are measured or when measured forces are below a predetermined, albeit preferably adjustable fourth threshold for the first time after the anchor has been lowered, or within a time window around an expected point in time at which the anchor may be expected to touch ground as described above in connection with vibration measurements.

In yet another preferred variant of the method for determining a displacement of an anchor, the step of measuring at least one further physical quantity comprises measuring a presure, in particular an underwater pressure at a location of the anchor, e.g., by using a pressure sensor attached to the anchor; and/or measuring an inclination or orientation of the anchor, e.g., by using a compass or an inclination sensor attached to the anchor; and/or by measuring a distance between the anchor and an at least approximately fixed reference point. Measurements thus obtained may be used in deciding whether the anchor is at rest or in motion. In particular, it may be assumed that the anchor is at rest when measurements have yielded at least approximately constant values constant over a predetermined, albeit preferably adjustable period of time. Measurements thus obtained may be used in determining the initial position of the anchor in an analogous manner as described above in connection with vibration and force measurements.

In a preferred variant of the method for determining a displacement of an anchor, acceleration values corresponding to intervals when the anchor is deemed to be at rest are ignored, i.e., disregarded, in the integration, and thus do not contribute to the determination of the displacement.

In another preferred variant of the method for determining a displacement of an anchor, acceleration values corresponding to intervals when the anchor is deemed to be at rest are used to correct the integration during intervals when the anchor is deemed to be in motion.

In particular, this may be achieved by assuming that a relation between actual acceleration values $a_a(t)$ and measured acceleration values $a_m(t)$ can, at least approximately, be described by $$a_m(t)=a_a(t)+e_{const}+e_{stat}(t)$$

where $e_{const}$ is an at least approximately constant error independent of time introduced by measurement, in particular by a constant offset of an acceleration sensor; and $e_{stat}(t)$ is a statistical error having, at least approximately, zero average and/or integral over a sufficiently large period of time. For any given second interval during which the anchor is deemed to be at rest, or any subinterval thereof, $e_{const}$ and $e_{stat}(t)$ may be determined from, in particular approximated according to $$a_m(t)=e_{const}+e_{stat}(t)$$

e.g., by minimizing the average and/or integral of $e_{stat}(t)$ over the present second interval, or any subinterval thereof. The value for $e_{const}$ thus obtained may be used, e.g., to correct the measured value $a_m(t)$ for one or more succeeding first intervals according to $$a(t)=a_m(t)-e_{const},$$

and using the corrected values a(t) in the integration. For the present and/or succeeding second intervals, the measured value $a_m(t)$ may be corrected in the same manner, or, preferably, it is assumed that $a(t)=a_a(t)=0$ for the present and/or succeeding second intervals; and the integration is further corrected by using the corrected values a(t) in the integration. Alternatively, the integration is preferably carried out over the subsequent first intervals only, thus obtaining a plurality of partial integrals, and by subsequently adding said partial integrals. The latter variant corresponds to at least effectively to pausing the integration during the present and/or subsequent second intervals.

In yet another preferred variant of the method for determining a displacement of an anchor, the initial position of the anchor is determined from a combined observation and/or analysis of at least a pair of vibration, pressure and/or acceleration values as functions of time, where it is assumed that when the anchor hits ground, a more or less sharp acceleration peak occurs, followed by an at least momentary minimum in vibrations and an abrupt fall-off to at least approximately zero in a pressure change-rate.

The initial position is preferably determined in an automated manner by an evaluation unit which is preferably configured to also carry out the remaining method steps. Alternatively, the initial position may also be determined by an experienced skipper or helmsman based on observations of and during the anchoring process.

Further, a system for determining a displacement of an anchor is presented. In accordance with the invention, the system comprises: a measurement unit for being attached to an anchor or an anchor rode, and comprising an element for acquiring acceleration data, in particular an acceleration sensor; and an auxiliary measuring element for measuring at least one further physical quantity associated with the anchoring, in particular one or more auxiliary sensors; an evaluation unit, in particular for being installed or placed inside a water vessel or in the measurement unit and configured to receive the acceleration data; wherein the system, in particular the evaluation unit, is configured to determine anchor acceleration values, preferably as a function of time, from the acquired acceleration data, and to execute the method for determining a displacement of an anchor according to any one or more of the variants as described above, using the determined acceleration values and the at least one further physical quantity measured by the auxiliary measuring element, in particular by the one or more auxiliary sensors.

In a preferred embodiment of the system for determining a displacement of an anchor in accordance with the invention, the measurement unit comprises a first communication module for transmitting measurement data, in particular acceleration data and data provided by the one or more auxiliary sensors, to an evaluation unit. The evaluation unit is configured to be installed or placed inside the water vessel, and comprises a second communication module configured to receive measurement data from the first communication module. Preferably, the first and second communication modules use sonic elements for transmitting and/or receiving data. In addition, the evaluation unit comprises or is connectible to a display for displaying the displacement and/or an absolute movement, e.g., an absolute value of the displacement, in particular as functions of time, force, position, distance, depth and/or orientation.

In another preferred embodiment of the system for determining a displacement of an anchor, the evaluation unit is integrated with the measurement unit. In this variant, the evaluation unit or measurement unit preferably comprises or is connected to a transmitter module for transmitting displacement data determined by the evaluation unit and/or related information to a receiver module in the water vessel comprised within or connectible to a display for displaying the displacement and/or an absolute movement, e.g., an absolute value of the displacement, in particular as functions of time, force, position, distance, depth and/or orientation.

In the embodiments described above, the display may further be configured to display measured acceleration values and/or the at least one measured further physical quantity, in particular as functions of time. Further, the evaluation unit or the receiver unit may comprise or be connectible to an input to allow for an input of user commands, in particular for manual setting of the initial position.

In embodiments as described above and/or below, the measurement unit; the sensor for acquiring acceleration data, in particular the acceleration sensor; and/or the auxiliary sensing element, in particular the one or more auxiliary sensors; are tightly connected to the anchor in order to ensure that they will remain in close proximity, preferably in physical contact to the latter to allow for exact determination of the displacement and exact measurement of the further physical quantity, in particular of vibrations. Preferably, they are rigidly attached to or fixed to, in particular integrated with, the anchor, so that they always maintain an identical relative position to the anchor. Alternatively, they may be rigidly attached to or fixed to, in particular integrated with, a shackle or chain element provided for linking, preferably releasably linking, the anchor with the anchor rode, thus constituting a connecting link.

In another preferred embodiment of the system for determining a displacement of an anchor, the system is configured to generate a warning signal, an alarm or a similar kind of notification if the displacement, in particular an absolute value of the displacement, exceeds a predetermined alarm threshold. This way, a water vessel secured with the anchor may be maintained under reduced attendance, in particular during night time or rest times of the crew, if naval and weather conditions permit. Also, remote supervision and/or automated action is possible if the system is configured to transmit the warning signal, an alarm or a similar kind of notification to a remote location, or to an additional system configured to take appropriate action in an automated manner.

According to another exemplary embodiment of the present invention, a system for monitoring an anchoring reliability is presented. The system comprises: a measurement unit for being attached to an anchor or an anchor rode, and comprising an element for acquiring acceleration data, in particular an acceleration sensor; and an auxiliary measuring element for measuring at least one further physical quantity associated with the anchoring, in particular one or more auxiliary sensors; an evaluation unit, in particular for being installed or placed inside a water vessel or in the measurement unit and configured to receive the acceleration data; wherein the system, in particular the evaluation unit, is configured to determine an initial position of the anchor, in particular when the anchor has reached ground and may be deemed to be at rest, determine a displacement of the anchor, in particular from the initial position, determining anchor acceleration values, preferably as function of time, from the acquired acceleration data, measuring at least one further physical quantity, preferably as function of time, associated with the anchoring by using the auxiliary measuring element, in particular by the one or more auxiliary sensors, deciding whether the anchor is at rest or in motion, wherein a value of the further physical quantity is taken into account in the decision, and integrating twice the anchor acceleration values over time for intervals when the anchor is supposed to be in motion.

FIG. 1 shows a schematic of an exemplary embodiment of a system for determining a displacement of an anchor in accordance with the present invention.

As an exemplary water vessel, a yacht 2 is anchored using an anchor 1 resting on a seafloor at a current position $\vec{x}$. The anchor 1 is fixed to an anchor rode 3 using a connecting link 11. The anchor rode is further attached to yacht 2 at an end remote from connecting link 11.

Connecting link 11 comprises a measurement unit which, as detailed above, in turn comprises an element for acquiring acceleration data, in particular an acceleration sensor; as well as one or more auxiliary sensors for measuring at least one further physical quantity associated with the anchoring.

The measurement unit further comprises a first communication module for sonically transmitting measurement data, in particular acceleration data and data provided by the one or more auxiliary sensors, to an evaluation unit located in yacht 2. The evaluation unit comprises a second communication module 21 configured to receive measurement data from the first communication module. The evaluation unit is connected to a graphic display 22 located in yacht 2.

A touchdown location at which the anchor first touched the seafloor upon lowering is indicated by reference symbol 1'.

The evaluation unit is configured to determine anchor acceleration values from the acquired acceleration data, and execute the method for determining a displacement of an anchor as previously described, using the determined acceleration values and the at least one further physical quantity measured by the one or more auxiliary sensors.

Although the invention is illustrated and described herein with reference to specific embodiments, the invention is not intended to be limited to the details shown. Rather, various modifications may be made in the details within the scope and range of equivalents of the claims and without departing from the invention.

It should be noted that the term "comprising" does not exclude other features, in particular elements or steps, and that the indefinite articles "a" or "an" do not exclude a plurality of the elements or steps said articles relate to. Further, elements or steps as described in association with two or more different individual embodiments may be combined.

The invention claimed is:

1. A method for determining a displacement of an anchor, the method comprising the steps of:

(a) determining an initial position of the anchor;

(b) determining a displacement of the anchor by i. measuring anchor acceleration values using an acceleration sensor, ii. measuring at least one further physical quantity associated with the anchor using an auxiliary sensor to determine intervals when the anchor is at rest, iii. transmitting data related to the measured anchor acceleration values, and related to the measured at least one further physical quantity, to a communication module, iv. using the data transmitted at step iii to determine intervals during which the anchor is at rest or in motion, v. during intervals when the anchor is deemed to be in motion, integrating the acceleration values twice over time to determine the displacement of the anchor, and vi. correcting the integration of the acceleration values based on the anchor acceleration values measured by the acceleration sensor during intervals when the anchor is deemed to be at rest, thereby improving the determination of the displacement of the anchor from the initial position; and (c) displaying at least one of the displacement and an absolute movement of the anchor on a display.

2. The method according to claim 1 wherein step vi includes, ignoring anchor acceleration values measured during intervals when the anchor is deemed to be at rest.

3. The method according to claim 1, wherein the step of measuring at least one further physical quantity includes at least one of measuring vibrations of the anchor, measuring a force exerted onto the anchor through an anchor rode, and measuring an underwater pressure at a location of the anchor.

4. The method according to claim 1, wherein the step of measuring at least one further physical quantity includes at least one of measuring a distance between the anchor and a fixed reference point, measuring a distance between the anchor and a water vessel, measuring an inclination of the anchor, and measuring an orientation of the anchor.

5. The method of claim 1 further comprising the step of generating a warning message or signal after the displacement exceeds a predetermined alarm threshold.

6. A system for determining a displacement of an anchor, the system comprising:

(a) a measurement unit attached to at least one of an anchor and an anchor rode, the measurement unit including: i. an acceleration sensor for measuring anchor acceleration values, ii. an auxiliary sensor for measuring at least one further physical quantity associated with the anchor;

(b) an evaluation unit configured to be installed or placed inside a water vessel or in the measurement unit, the evaluation unit being configured to receive data related to the anchor acceleration values measured by the acceleration sensor, and configured to receive data related to the at least one further physical quantity measured by the auxiliary sensor, wherein the evaluation unit is configured to i. use the data transmitted to the evaluation unit to determine intervals during which the anchor is at rest or in motion, ii. during intervals when the anchor is deemed to be in motion, integrating the anchor acceleration values twice over time to determine the displacement of the anchor, and iii. correcting the integration of the anchor acceleration values based on the anchor acceleration values measured by the acceleration sensor during intervals when the anchor is deemed to be at rest, thereby improving the determination of the displacement of the anchor; and (c) a display for displaying at least one of the displacement and an absolute movement of the anchor.

7. The system according to claim 6, wherein the auxiliary sensor includes a plurality of auxiliary sensors.

8. The system according to claim 6, wherein the auxiliary sensor comprises a vibration detection unit configured to receive acceleration data from the acceleration sensor, and to measure vibrations, in particular an intensity and or an amplitude of vibrations, of the anchor by extracting vibration data from the acceleration data.

9. The system according to claim 6, wherein the display displays the at least one of the displacement and the absolute movement of the anchor as a function of at least one of time, force, position, distance, depth and/or orientation.

10. The system according to claim 6, configured to generate a warning message or signal after an absolute value of the displacement exceeds a predetermined alarm threshold.

11. The system according to claim 6, wherein the auxiliary sensor includes a plurality of auxiliary sensors including a pressure sensor for measuring underwater pressure; a vibration sensor for measuring vibrations of the anchor; an ultrasound sensor, in particular for measuring a distance between anchor and vessel; and/or a force sensor for measuring a force exerted onto the anchor through an anchor rode.

12. A system for determining a displacement of an anchor, the system comprising:

(a) a measurement unit for being attached to an anchor or an anchor rode, the measurement unit comprising: i. an acceleration sensor, ii. one or more auxiliary sensors;

(b) an evaluation unit, in particular for being installed or placed inside a water vessel (2) or in the measurement unit and configured to receive the acceleration data, wherein the evaluation unit is configured to i. determine an initial position of the anchor, in particular when the anchor has reached ground and is deemed to be at rest, and ii. determine a displacement of the anchor, wherein step ii. includes A. determining anchor acceleration values from acceleration data provided by the acceleration sensor, B. measuring at least one further physical quantity associated with the anchor using data provided by the one or more auxiliary sensors, C. determining whether the anchor is at rest or in motion, using the data provided by the one or more auxiliary sensors, D. for intervals when the anchor is determined to be in motion, integrating the anchor acceleration values twice over time, and E. correcting the integration of the acceleration values based on the anchor acceleration values measured by the acceleration sensor during intervals when the anchor is deemed to be at rest, thereby improving the determination of the displacement of the anchor from the initial position; and (c) a display for displaying at least one of the displacement and an absolute movement of the anchor.

13. The system according to claim 12, wherein the evaluation unit is configured to disregard the anchor acceleration values relating to intervals when the anchor is determined to be at rest when integrating over time, in particular by replacing said acceleration values by zero values, or by pausing the integration.

* * * * *